United States Patent [19]

Coates

[11] Patent Number: 4,989,558

[45] Date of Patent: Feb. 5, 1991

[54] SPHERICAL ROTARY VALVE ASSEMBLY FOR AN INTERNAL COMBUSTION ENGINE

[76] Inventor: George J. Coates, 2500 Belmar Blvd., Wall Township, Manmouth County, N.J. 07719

[21] Appl. No.: 409,037

[22] Filed: Sep. 14, 1989

Related U.S. Application Data

[63] Continuation of Ser. No. 270,037, Nov. 14, 1988, Pat. No. 4,953,527.

[51] Int. Cl.[5] ..... F01L 7/02

[52] U.S. Cl. ..... 123/190 D

[58] Field of Search ..... 123/190 D, 190 DB

[56] References Cited

U.S. PATENT DOCUMENTS

| | | | |
|---|---|---|---|
| 1,347,978 | 4/1920 | Wehr | 123/190 DB |
| 2,617,395 | 3/1953 | Haase | 123/190 E |
| 3,945,364 | 3/1976 | Cook | 123/190 D |
| 4,116,189 | 9/1978 | Asagg | 123/190 D |
| 4,198,946 | 4/1979 | Rassey | 123/190 A |

OTHER PUBLICATIONS

EPO-0071 478, Contes, Feb. 1983.

*Primary Examiner*—E. Rollins Cross

*Attorney, Agent, or Firm*—Clifford G. Frayne

[57] ABSTRACT

A spherical rotary valve assembly for an internal combustion engine of the piston and cylinder type wherein the spherical rotary valve assembly is positioned within a split cylinder head having an upper and lower section, such when secured defines a cavity for a rotational shaft having mounted thereon, an intake drum and exhaust drum for each cylinder, the lower half of the split head cylinder head having positioned therein, the inlet port and outlet port for the cylinder, the split cylinder head having an intake passageway and an exhaust passageway in communication with the drum cavities in the split cylinder head, the rotation of the respective intake drum and exhaust drum within their respective cavities interrupting the respective flow of the fuel air mixture or the exhaust gases to or from the cylinder by means of passageways within the drums, the drums rotating within the cavities in a gas tight sealing rotation on an annular sealing means axially positioned about the inlet port and outlet port in the lower section of the split head assembly such that the frictional contact encountered is that of the drums in contact with the seals and the shaft in contact with journaled bearings in the split head assembly, there being a pair of drums associated with each cylinder.

13 Claims, 9 Drawing Sheets

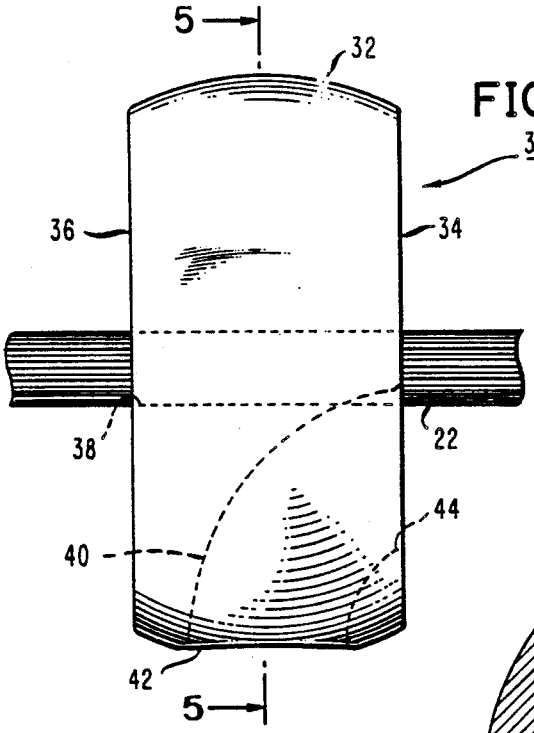
FIG. 4
FIG. 5
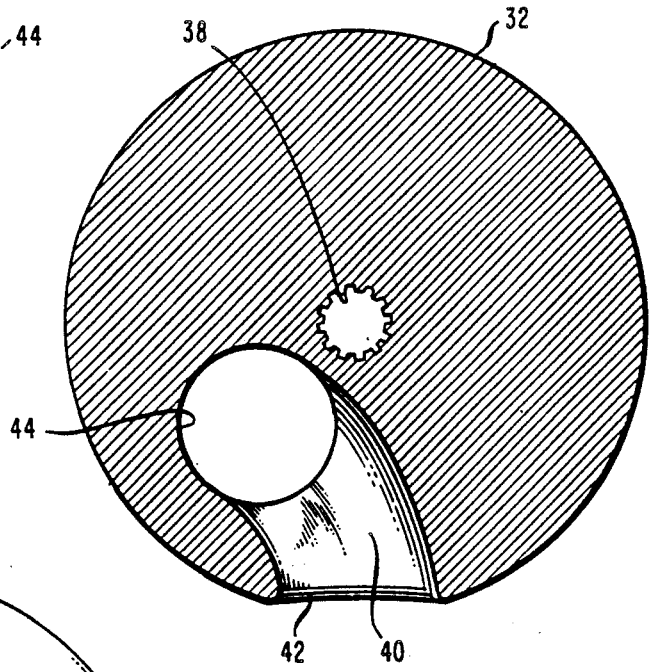
FIG. 6
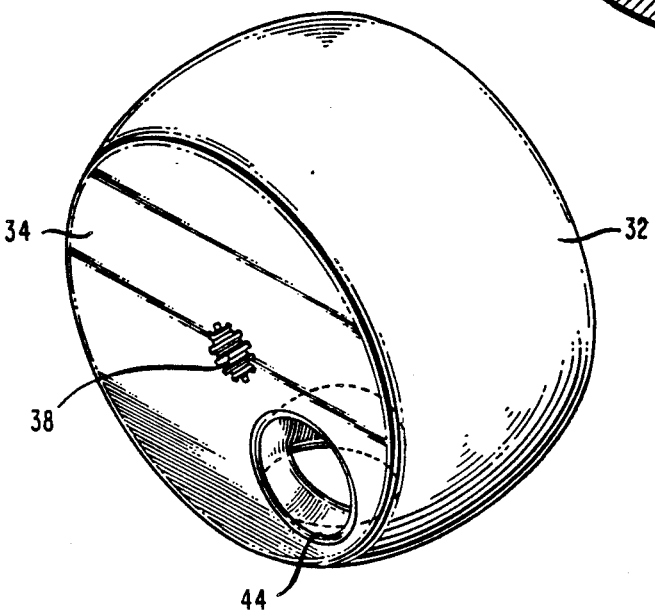

FIG. 13
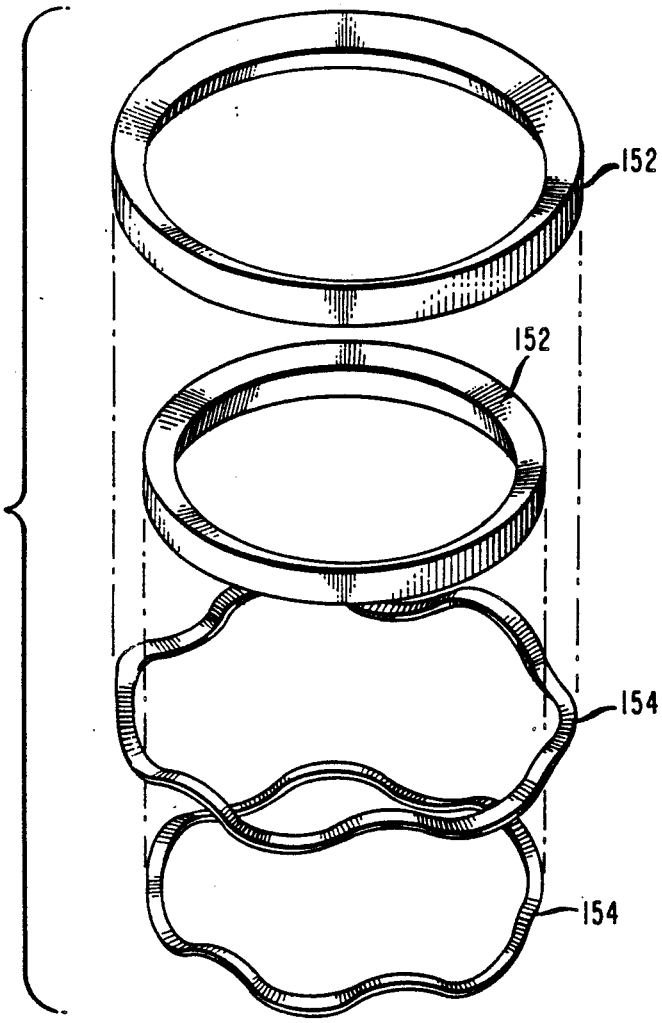
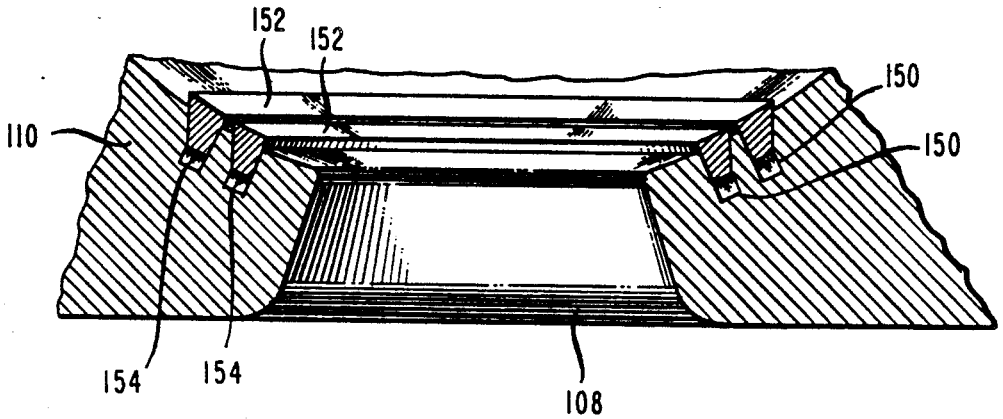

SPHERICAL ROTARY VALVE ASSEMBLY FOR AN INTERNAL COMBUSTION ENGINE

This is a continuation of application Ser. No. 07/270,037, filed Nov. 14, 1988 now U.S. Pat. No. 4,953,527.

FIELD OF INVENTION

This invention relates to an internal combustion engine of the piston and cylinder type and, more particularly, to a spherical rotary valve assembly for the introduction of the fuel and air mixture to the cylinder and the evaluation of exhaust gases.

BACKGROUND OF THE INVENTION

In an internal combustion engine of the piston and cylinder type, it is necessary to charge the cylinder with a fuel and air mixture for the combustion cycle and to vent or evacuate the exhaust gases at the exhaust cycle of each cylinder of the engine. In the conventional piston and cylinder type engine, these events occur thousands of times per minute per cylinder. In the conventional internal combustion engine, the rotation of a cam shaft causes a spring-loaded valve to open to enable the fuel and air mixture to flow from the carburetor to the cylinder and combustion chamber during the induction stroke. This cam shaft closes this intake valve during the compression and combustion stroke of the cylinder and the same cam shaft opens another spring-loaded valve, the exhaust valve, in order to evacuate the cylinder after compression and combustion have occurred. These exhaust gases exit the cylinder and enter the exhaust manifold.

The hardware associated with the efficient operation of conventional internal combustion engines having spring-loaded valves includes items such as springs, cotters, guides, rocker shafts and the valves themselves which are usually positioned in the cylinder heads such that they normally operate in a substantially vertical position, with their opening, descending into the cylinder for the introduction or venting or evacuation of gases.

As the revolutions of the engine increase, the valves open and close more frequently and the timing and tolerances become critical in order to prevent the inadvertent contact of the piston with an open valve which can cause serious engine damage. With respect to the aforementioned hardware and operation, it is normal practice for each cylinder to have one exhaust valve and one intake valve with the associated hardware mentioned heretofore; however, many internal combustion engines have now progressed to multiple valve systems, each having the associated hardware and multiple cam shafts.

In the standard internal combustion engine, the cam shaft is rotated by the crankshaft by means of a timing belt or chain. The operation of this cam shaft and the associated valves operated by the cam shaft presents the opportunity to decrease engine efficiency through the friction associated with the operation of the various elements. Applicant's invention is directed towards a novel valve means which eliminates the need for spring-loaded valves and the associated hardware and in its simplest explanation, enlarges the cam shaft to provide for spherical rotary valves to feed each cylinder. This decreases the number of moving parts and hence the friction involved in the operation of the engine and increases engine efficiency. It also eliminates the possibility of the piston contacting an open valve and thus causing serious engine damage. In fact, where an individual may have difficulty turning a conventional cam shaft by hand, the same individual can easily turn Applicant's apparatus.

OBJECTS OF THE INVENTION

An object of the present invention is to provide a novel and unique valve mechanism for internal combustion engines which eliminates the need for spring-loaded valves.

Another object of the present invention is to provide a novel and unique valve mechanism for internal combustion engines which increases the efficiency of the engine.

Another object of the present invention is to provide a novel and unique valve mechanism for internal combustion engines which decreases the friction generated by an internal combustion engine and increases the efficiency of the engine.

A still further object of the present invention is to provide for a novel and unique valve mechanism for an internal combustion engine which has fewer moving parts and thus permits the engine to operate at higher revolutions per mintute.

A still further object of the present invention is to provide for a novel and unique valve mechanism for internal combustion engines which is adaptable for four stroke, eight stroke or sixteen stroke engines with straight heads or V-shaped configurations.

A still further object of the present invention is to provide a novel and unique valve mechanism for internal combustion engines which can be utilized with internal combustion engines which are fuel injected or carbureted.

SUMMARY OF THE INVENTION

A spherical rotary valve assembly for an internal combustion engine which is comprised of a piston and cylinder-type engine which includes an attachable cylinder split head assembled from two hollowed out components to provide a cavity having radial symmetry with the cylinder head and where the cavity is divided into a first and second spherical drum accommodating section for each cylinder of the engine, each spherical drum having a spherical section defined by two parallel planes intersecting a sphere, the planes being disposed symmetrically about the center of the sphere, the intersection between the planes and the spherical section being rounded off, the intake spherical drum having an annular doughnut indent in one intersecting plane and aperture on said spherical periphery drum surface, communicating with said annular doughnut indent, the intake spherical drum in communication with the passageway for introduction of a fuel air mixture traversing the cylinder head, the fuel air mixture entering the annular cut in the spherical drum and sequentially entering the cylinder head when the aperture on the spherical periphery of the drum is in registration with the inlet port to the cylinder head, the fuel air mixture sealed off from the cylinder head when the aperture in the spherical periphery is not in registration with the inlet port, the exhaust spherical drum having an aperture on the spherical periphery of the drum for registration with the outlet port of the cylinder, the spherical exhaust drum having a second aperture in the lateral sidewall plane of the spherical drum, in communication with said aperture in said spherical periphery, the exhaust gases of the cylinder evacuating the cylinder through the spherical exhaust drum and entering the exhaust manifold.

BRIEF DESCRIPTION OF THE DRAWINGS

The objects of the invention as well as other benefits will become evident after consideration of the drawings wherein:

FIG. 4 is a side view of the exhaust spherical drum;

FIG. 5 is a front sectional view of the exhaust spherical drum;

FIG. 6 is a perspective view of the exhaust spherical drum;

FIG. 13 is an exploded perspective view of a second embodiment of a sealing ring;

FIG. 14 is a section view of the second embodiment of the sealing ring;

DETAILED DESCRIPTION OF THE DRAWINGS

Figure 1:
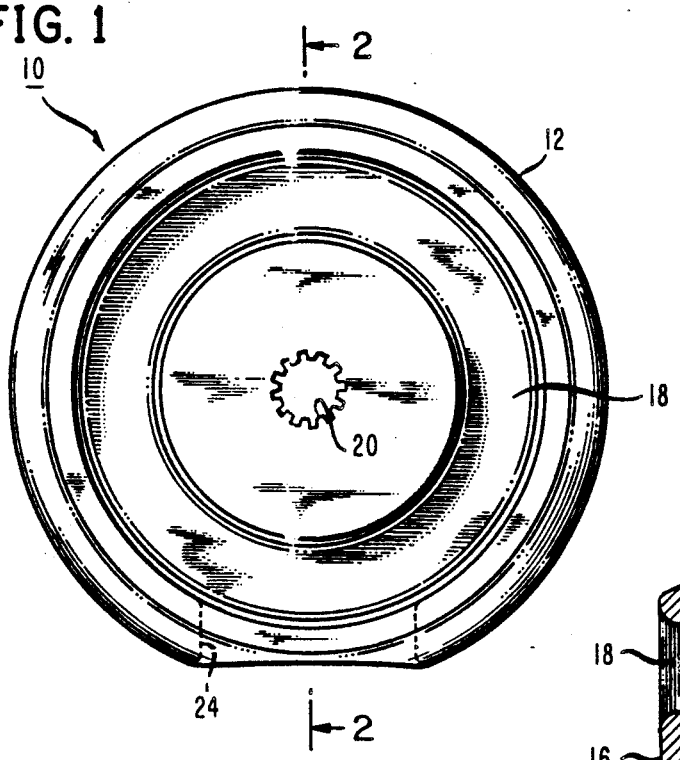
FIG. 1 is a front view of the intake spherical drum.
Figure 2:
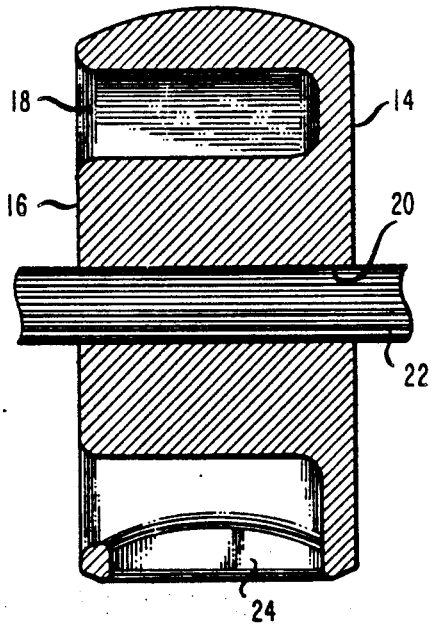
FIG. 2 is a side sectional view of the intake spherical drum.
Figure 3:
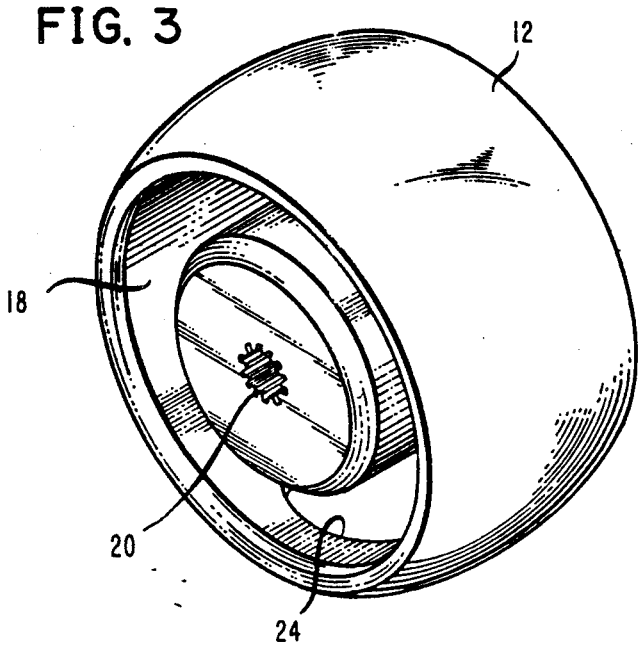
FIG. 3 is a perspective view of the intake spherical drum.

Considering FIGS. 1, 2 and 3, there is shown the intake spherical drum of the spherical rotary valve assembly. The intake spherical drum 10 is defined by an arcuate spherical circumferential periphery 12 and planer sidewall 14 and planer wall 16, opposite planer sidewall 14 which is parallel to sidewall 14 with the intersecting edges of planer sidewall 16 and 14 with arcuate spherical circumferential periphery 12 being rounded off. The arcuate extension of circumferential periphery 12 as shown in the side cross sectional view FIG. 1 would define a circle. Centrally-disposed inwardly from planer sidewall 16 is an annular U-shaped or doughnut cavity cavity 18 which extends from planer sidewall 16 to a depth approximate to planer sidewall 14. The corners and edges of U-shaped cavity 18 are preferably machined such that they are rounded. There is centrally disposed through intake spherical drum 10, a central aperture 20 extending from planer sidewall 16 through to planer sidewall 14, aperture 20 being centrally disposed through intake spherical drum 10. Centrally disposed aperture 20 provides the means for mounting intake spherical drum 10 on the centrally disposed shaft 22 to provide for the rotational disposition of intake spherical drum 10 as further described hereafter. In this embodiment, aperture 20 and shaft 22 are shown longitudinally threaded; however, other mounting means as described hereafter are suitable.

Passing through arcuate spherical circumferential periphery 12 and providing communication with annular U-shaped or doughnut cavity 18 is an intake aperture 24. Intake aperture 24 is circular in cross sectional area and is designed to communicate with the inlet port of the cylinder during the rotational disposition of spherical intake drum 10 as described hereafter. Preferably, the intersecting edge of intake aperture 24 and its intersection with arcuate circumferential periphery 12 is machined to a rounded radius.

Considering FIGS. 4, 5 and 6, there is shown respectively, a side, front sectional and perspective view of the exhaust spherical drum 30. Exhaust spherical drum 30 has a arcuate spherical circumferential periphery 32 and planer parallel sidewalls 34 and 36 intersecting with arcuate spherical circumferential periphery 32, the edges of such intersection preferably being rounded. Exhaust spherical drum 30 has disposed centrally therethrough, from planer sidewall 36 to planer sidewall 34, a centrally disposed aperture 38 for the mounting of exhaust spherical drum 30 on shaft 22 for the rotational disposition of exhaust spherical drum 30 as described hereafter.

Exhaust spherical drum 30 has defined therethrough, an exhaust conduit 40 defined by a first exhaust aperture 42, substantially circular in cross sectional area and positioned on arcuate circumferential periphery 32 of exhaust spherical drum 30 and a second exhaust port aperture 44 positioned on planer sidewall 34 of exhaust spherical drum 30. Exhaust aperture 42 is designed for alignment with the exhaust port of the cylinder as described hereafter, and exhaust port 44 is designed for alignment with the exhaust manifold, the conduit between exhaust ports 42 and 44 providing for the means for escape or evacuation of exhaust gases from the cylinder as described hereafter.

The concept of the spherical rotary valves is to eliminate the need for pushrod valves and their associated hardware and to provide a means for charging the cylinder for its power stroke and evacuating the cylinder during its exhaust stroke. As will be more apparent hereafter with reference to the more detailed drawings, the intake spherical drum 10 has U-shaped or doughnut cavity 18 in constant communication with the incoming fuel-air mixture from the carburetor and this fuel-air mixture in U-shaped or doughnut cavity 18 is introduced into the cylinder when inlet aperture 24 comes into rotational alignment with the inlet port in the lower half of the cylinder head. When intake aperture 24 is not in alignment with the inlet port of the cylinder, arcuate circumferential periphery 12 serves to seal the inlet port of the cylinder. With respect to the exhaust stroke of the cylinder, the arcuate circumferential periphery 32 of exhaust spherical drum 30 maintains a seal on the exhaust port of the cylinder until first exhaust port 42 on arcuate circumferential periphery 32 of exhaust spherical drum 30 comes into rotational alignment with the exhaust port of the cylinder positioned in the lower half of the cylinder head. The exhaust stroke of the piston then forces the evacuation of the gases through first exhaust port 42 and internal conduit 40 to second exhaust port 44 and thence to the exhaust manifold.

It will be recognized by one skilled in the art that the positioning of intake aperture 24 on intake spherical drum 10 and first exhaust port 42 on exhaust spherical drum 30 is done with consideration with respect to the power strokes and exhaust strokes of the piston within the cylinder and the timing requirements of the engine.

Figure 7:
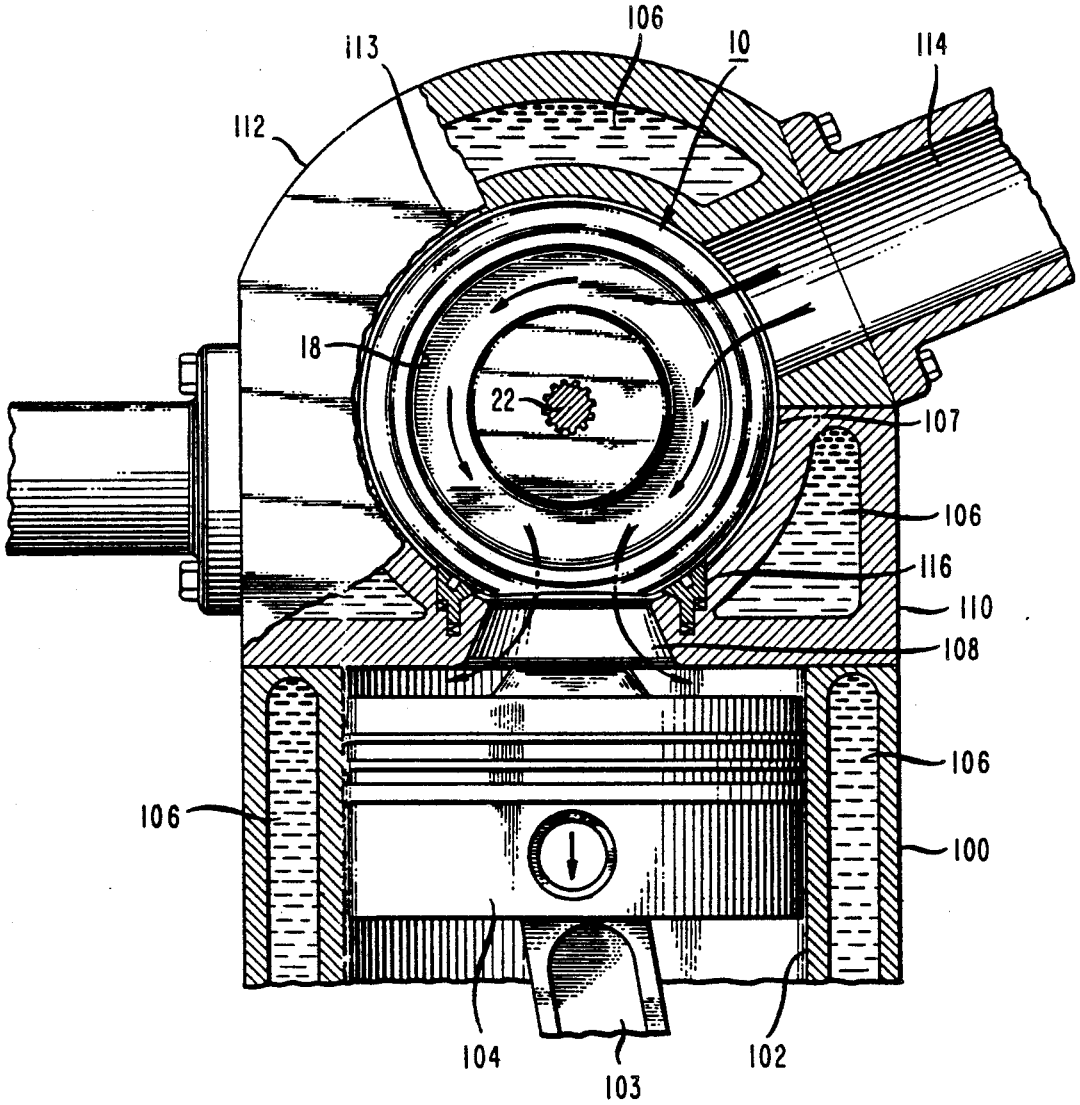
FIG. 7 is a front sectional view of a cylinder with the intake spherical drum.

Referring to FIG. 7, there is shown a side sectional view of the cylinder and cylinder head with internal piston in conjunction with the intake spherical drum. The cylinder and piston and block are similar to that of a conventional internal combustion engine. There is shown an engine block 100 having disposed therein, a cylinder cavity 102 there being positioned within cylinder cavity 102, a reciprocating piston 104 which is secured to a crankshaft 103 and which moves in a reciprocating action within cylinder cavity 102. The cylinder cavity itself is surrounded by a plurality of enclosed passageways 106 designed to permit the passage therethrough of a cooling fluid to maintain the temperature of the engine. As will be recognized by one skilled in the art, when the head is removed from an internal combustion engine, the cylinder cavity and piston enclosed therein, can be viewed. Applicant's engine head is a split head comprising a first lower section 110 which is secured to the engine block 100 and contains an intake port 108 for cylinder 102. Intake port 108 is positioned in a hemispherical drum accommodating cavity 107 defined by the intersection of two perpendicular parallel planes in order to accommodate the positioning of intake spherical drum 10. The upper half 112 of the split head assembly also contains a hemispherical drum accommodating cavity 113 defined by the intersection of two parallel planes in order to define a cavity for receipt of the upper half of intake spherical drum 10. When upper half 112 and lower half 110 of the head are secured to the engine block by standard head bolts, intake spherical drum 10 is rotationally encapsulated within the cavity defined by the two halves of the split head assembly. See FIGS. 9 and 10 for a perspective view of the split head drum relationship. U-shaped or doughnut cavity 18 is in communication with the inlet port 114 to permit the fuel-air mixture to flow into U-shaped or doughnut cavity 18. A sealing mechanism 116 as described hereafter, is positioned about inlet port 108 to cylinder cavity 102 in order to provide an effective seal during the rotational disposition of intake spherical drum 10. Lower and upper section 110 and 112 of the head also contain a plurality of interior passageways 106 to provide for the passage of cooling fluid. Appropriate oil ducts can also be provided for lubrication.

In the perspective view as shown in FIG. 7, the intake spherical drum 10 is emphasized. Directly behind intake spherical drum 10 would be exhaust spherical drum 30 whose operation with respect to the piston will be disclosed hereafter.

U-shaped or doughnut cavity 18 on intake spherical drum 10 is continually charged with a fuel-air mixture through inlet port 114. This fuel-air mixture is not introduced into cylinder cavity 102 until intake aperture 24 comes into rotational alignment with inlet port 108. Sealing mechanism 116 cooperates with the arcuate circumferential periphery 12 of intake spherical drum 10 to provide an effective gas tight seal to ensure that the fuel-air mixture passes from U-shaped or doughnut cavity 18 through inlet port 108 and into cylinder cavity 102. In normal operation, this introduction occurs with the downward movement of piston 104 during the intake stroke thus charging the cylinder with a fuel-air mixture. As soon as the inlet aperture 24 has been closed such that it is no longer in alignment with inlet port 108, the arcuate spherical circumferential periphery 12 of intake spherical drum 10 would seal the inlet port in preparation for the power stroke of piston 104 and the ignition of the fuel-air mixture. The rotation of intake spherical drum 10 is with shaft 22 upon which, in a single shaft engine, all subsequent pairs of intake spherical drums and exhaust spherical drums would be mounted, each pair in alignment with a cylinder cavity 102. Shaft 22 would be in rotational communication by means of a timing chain or other similar device, described hereafter, with a crankshaft to which the pistons 104 are mounted. This thus ensures the timing of the opening and closing of inlet port 108.

Figure 8:
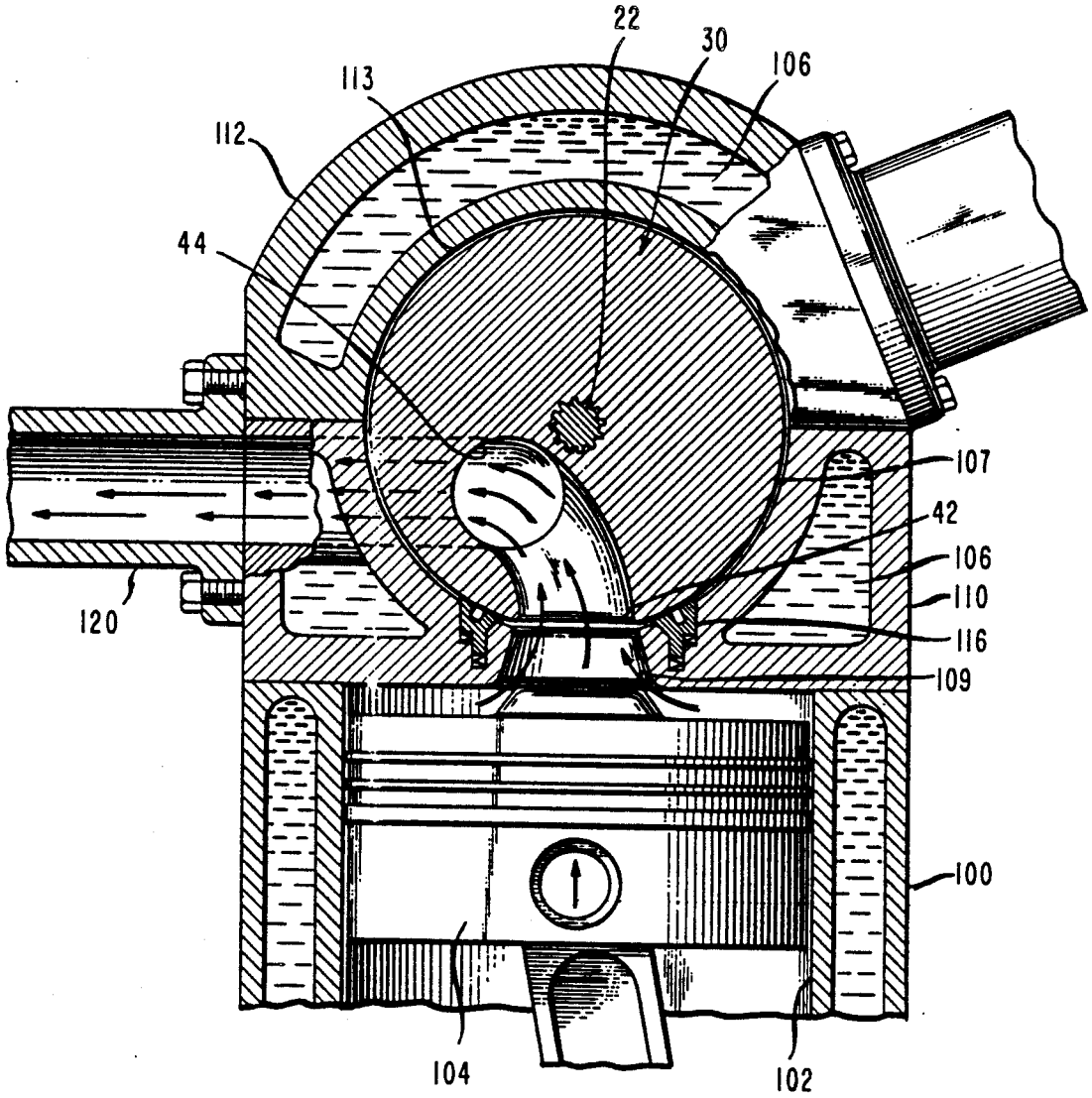
FIG. 8 is a front sectional view of a cylinder with the exhaust spherical drum.

Referring to FIG. 8, there is shown a side sectional view of a cylinder, head, and intake and exhaust manifolds describing in this context, the operation of the exhaust spherical drum 30.

Again, there is disclosed an engine block 100 having a cylinder cavity 102 disposed therein, with a reciprocating piston 104 within the cylinder cavity 102. Lower and upper heads 110 and 112 are secured to the engine block 100 and in this figure, the exhaust spherical drum 30 is disclosed. Exhaust spherical drum 30 is rotationally disposed within lower half and upper half 110 and 112 of the split head assembly in a drum accommodating cavity 107 and 113 similar to intake spherical drum 10 and is in communication with an exhaust port 109 for cylinder cavity 102. In the exhaust mode, the piston 104 has completed its power stroke, thus compressing and igniting the fuel-air mixture within the cylinder. This power stroke is accomplished with the arcuate spherical circumferential periphery of intake spherical drum 10 and exhaust spherical drum 30 providing the required sealing closure of the respective inlet port 108 and exhaust port 109. The ignition of the fuel-air mixture serves to drive piston 104 downwardly within cylinder cavity 102 and thence, piston 104 begins its ascent in the exhaust stroke. Exhaust spherical drum 30 rotating with shaft 22 and in timing communication with the crankshaft rotates to bring first exhaust port 42 in communication with exhaust port 109. In this configuration, a conduit passageway is defined through exhaust spherical drum 30 from exhaust port 109 at the top of the cylinder head, to first exhaust aperture 42 on arcuate spherical circumferential periphery 32 of exhaust spherical drum 30, and thence through interior conduit 40 to second exhaust port 44 on the sidewall of exhaust spherical drum 30 and thence through exhaust conduits 120, the exhaust gases being evacuated to the ambient atmosphere. Exhaust spherical drum 30 continues its rotation such that first exhaust aperture 42 is rotated out of alignment with exhaust port 109 thus sealing cylinder cavity 102 proximate to piston 104's topmost ascent, at which point, the inlet aperture 24 on intake spherical drum 10 would be coming into rotational alignment with inlet port 108 for the introduction of fresh fuel-air mixture charge.

Exhaust spherical drum 30 is in contact with the sealing means 116 identical to the sealing means utilized with respect to intake spherical drum 10 and described hereafter.

Figure 9:
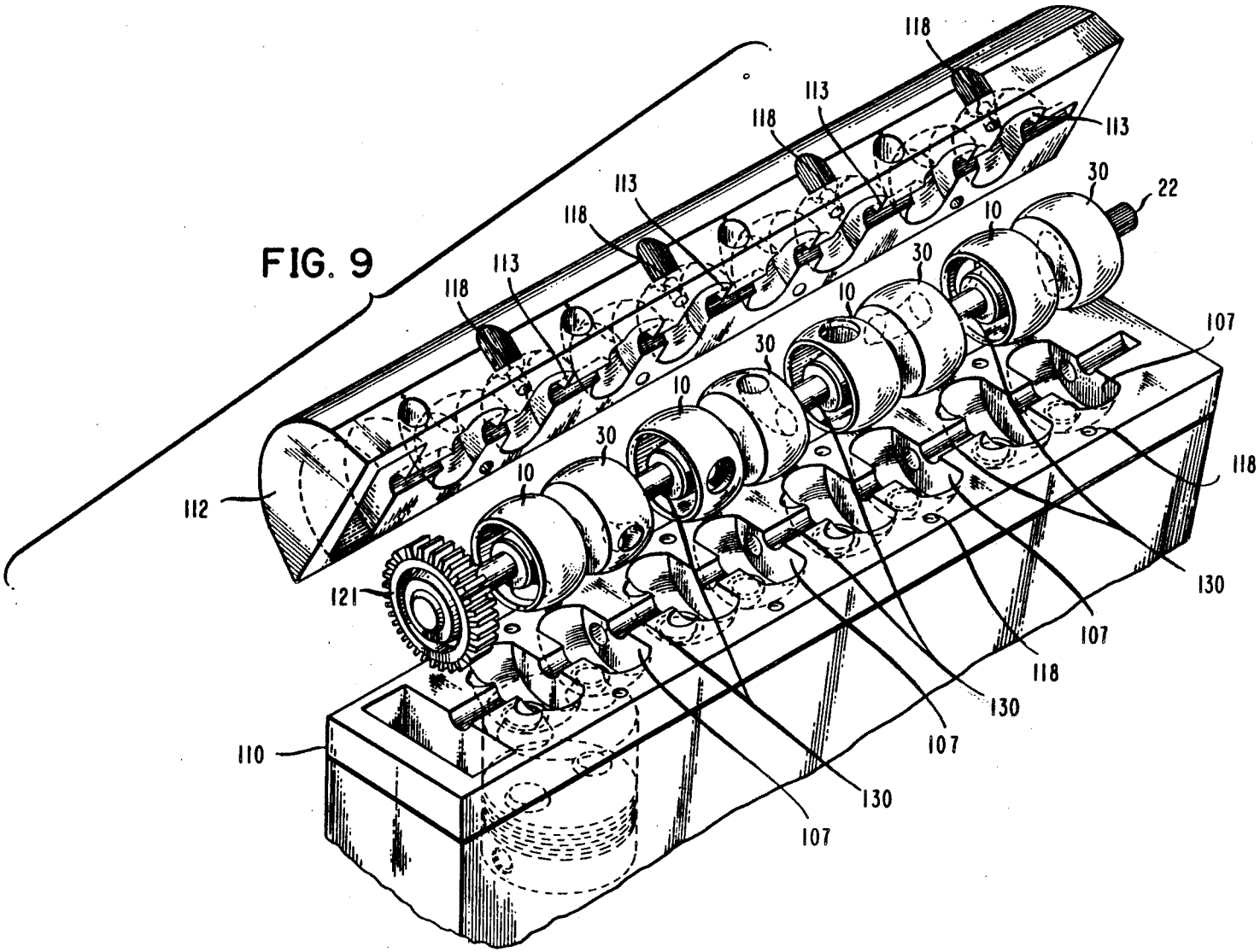
FIG. 9 is an exploded perspective view of the rotary spherical valve assembly and split heads.
Figure 10:
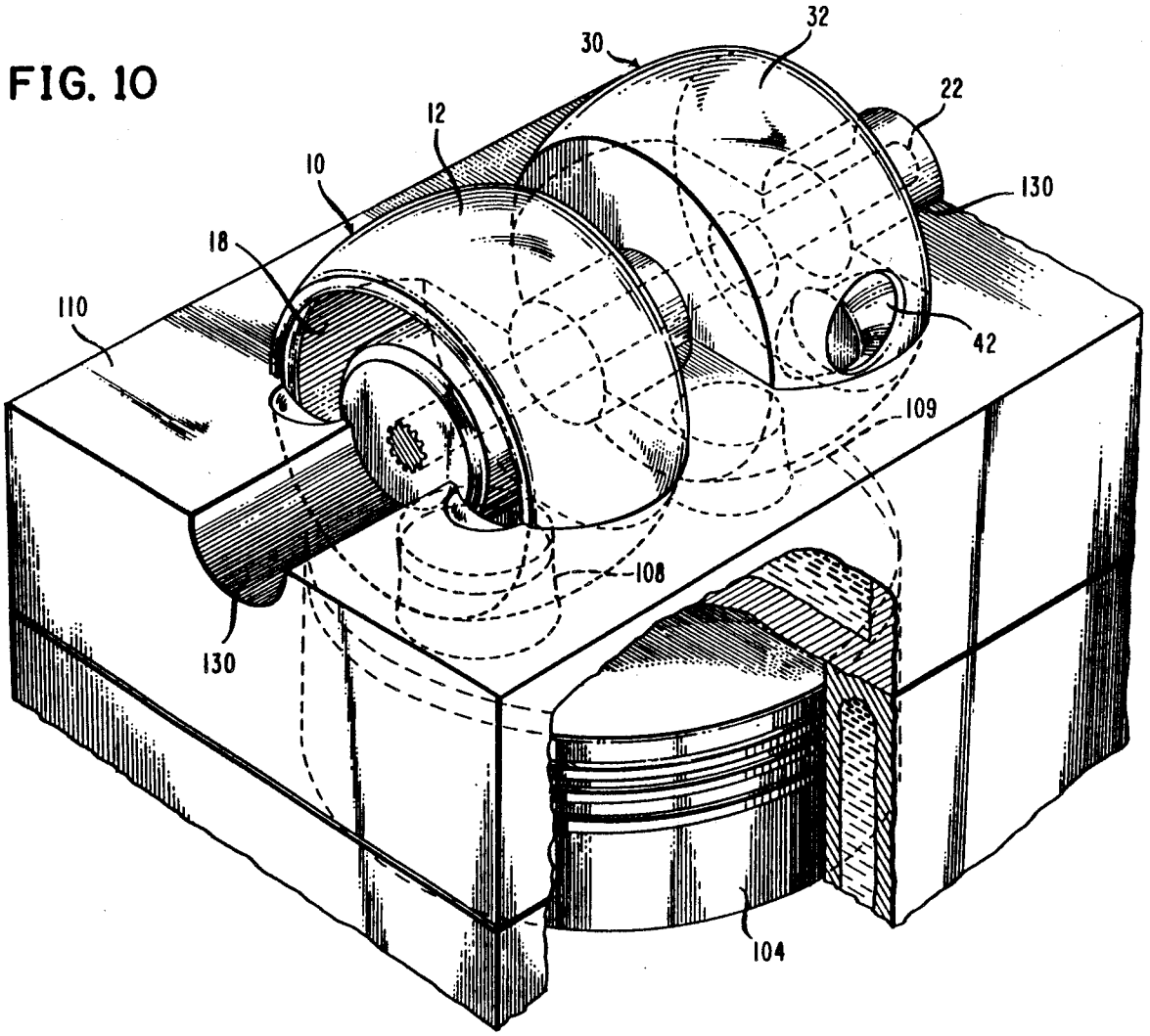
FIG. 10 is an exploded perspective view of an intake spherical drum and exhaust spherical drum as it relates to a single cylinder.

Referring to FIG. 9, there is shown a perspective view of the rotary spherical valve assembly mounted on shaft 22 for utilization in a four-cylinder engine. This figure shows paired relationship of intake spherical drum 10 and exhaust spherical drum 30 with respect to each cylinder in a four-cylinder engine. FIG. 10 is a perspective view of the rotary spherical valve assembly positioned within lower section 110 of the split head assembly with respect to a single cylinder. FIGS. 9 and 10 serve to show the relationship between the intake spherical drum 10 and the exhaust spherical drum 30 in positioning the spherical rotary valve assembly in the split head. It can be noted that there are a plurality of apertures 118 for receipt of a securing means in the form of head bolts in order to secure lower section 110 and upper section 112 of the split head to the engine block. Positioned at one end of shaft 22 is gear means 121 which is in communication with the crankshaft of the engine by means of a timing chain or belt in order to synchronize the rotation of the rotary spherical valve assembly with respect to the movement of the pistons within the cylinder. It will be recognized by one skilled in the art, that if a V-8 engine were utilized, each bank of cylinders would have one spherical rotary valve assembly associated therewith. Additionally, for a six-cylinder engine, there would be two additional pairs of intake spherical drums 10 and exhaust spherical drums 30 to accommodate the two additional cylinders. Additionally, as will be described hereafter, another embodiment of the invention would provide the intake spherical drums 10 to be positioned on one shaft and the exhaust spherical drums 30 to be positioned on an additional shaft for the advantages and efficiencies associated with what is traditionally known as a twin shaft engine. Shaft 22 and rotary spherical drums 10 and 30 are supported within the split head assembly on a plurality of bearing surfaces 130. Spherical drums 10 and 30 are machined as is the drum accommodating cavities 107 and 113, the tolerance between the spherical drums and the cavity being approximately one thousandth of an inch. When shaft 22 and the spherical drum assembly is positioned within the split head, shaft 22 contact bearing surfaces 130 and spherical drums 10 and 30 respectively are in contact only with sealing means 116, the embodiments of which are described hereafter.

Figure 11:
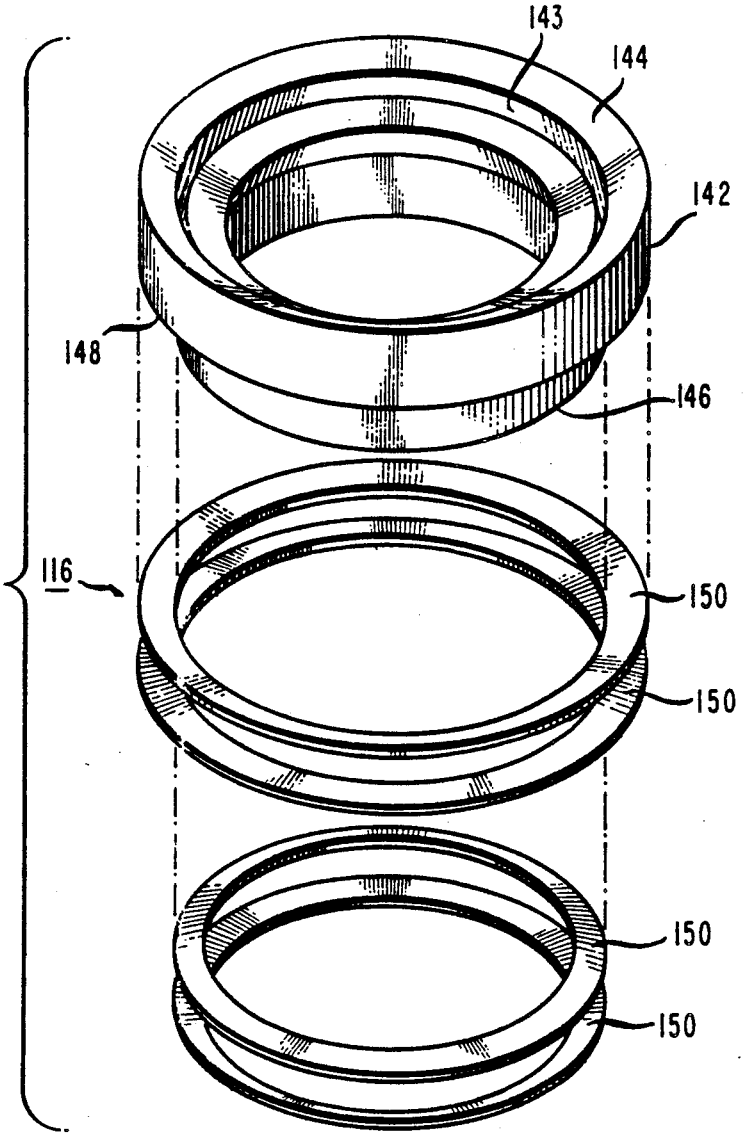
FIG. 11 is an exploded perspective view of a first embodiment of a sealing ring.
Figure 12:
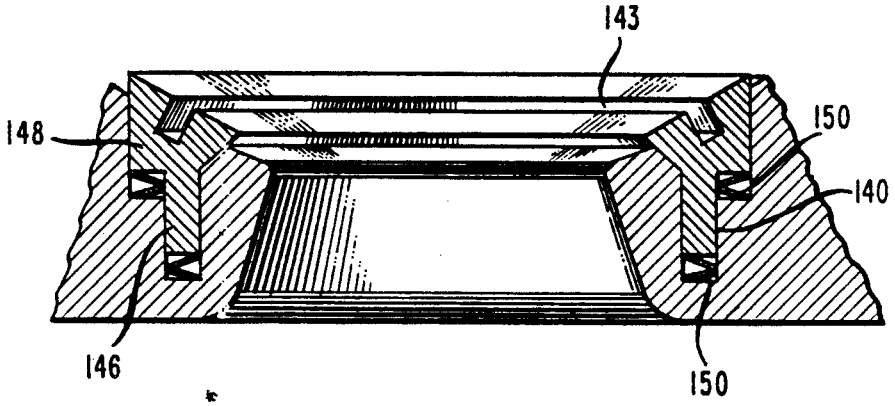
FIG. 12 is a sectional view of the first embodiment of the sealing ring.

Referring to FIG. 11, there is shown a perspective exploded view of a first embodiment of sealing mechanism 116 which is positioned within lower section 110 of the split head assembly. FIG. 12 is a cutaway side view of sealing mechanism 116. Lower section 110 of the split head assembly has an inlet port 108 and an outlet port 109 machined therein for communication with cylinder cavity 102. Circumferentially disposed about inlet port 108 or exit port 109 is a circumferential, machined annular indent 140 whose cross sectional area resembles an inverted L-shape. Sealing means 116 is inserted into this indent, sealing means 116 comprising a concave circular seal 142 whose upper surface 144 is concave shaped to conform to the spherical configuration of the chamber within lower section 110 of the split head assembly in order to conform to the annular, spherical circumferential periphery of either intake spherical drum 10 or exhaust spherical drum 30.

The lower portion of seal 142 comprises a downwardly depending annular leg 146 and a shoulder portion 148 designed to conform to the shape of annular indent 140. Beveled pressure springs 150 are positioned below depending leg 146 and shoulder 148 so as to provide a resilient compression to seal 142 in order to ensure intimate contact with the annular spherical circumferential periphery of intake spherical drum 10 or exhaust spherical drum 30. Beveled springs 150 ensure that upper surface 144 of seal 142 maintains contact with the arcuate spherical circumferential periphery of the intake or exhaust spherical drum. The upward pressure provided by springs 150 is normally in the range of 1–5 ounces to insure gas tight sealing contact.

The upper surface 144 of seal 142 is slightly arcuate in nature in order to conform with the arcuate spherical circumferential periphery of the intake or exhaust spherical drum 10 or 30 in order to ensure that a secure seal is maintained. Upper surface 144 may have one or more grooves 143 to assist in this sealing contact.

FIG. 13 is a perspective exploded view of a second embodiment of a sealing ring and FIG. 14 is a cross sectional view of the second embodiment of the sealing ring. In the second embodiment of the sealing ring, the sealing mechanism is positioned within lower section 110 of the split head assembly. Lower section 110 of split head assembly has positioned about the inlet port 108 or the outlet port 109, a plurality of circumferential indents 150. Disposed within indents 150 are circular seals 152 which have positioned below them in indents or grooves 150, either bevel springs or wave springs 154 in order to produce an upward resilient pressure on the seal 152 to maintain contact with intake spherical drum 10 or exhaust spherical drum 30. Seals 152 have incline sidewalls in order to conform to annular indents 150 which are perpendicular to the drum accommodating cavity 107. In this configuration, the center line of seal 152, if extended, would intersect the central axis of intake spherical drum 10 or exhaust spherical drum 30.

Figure 15:
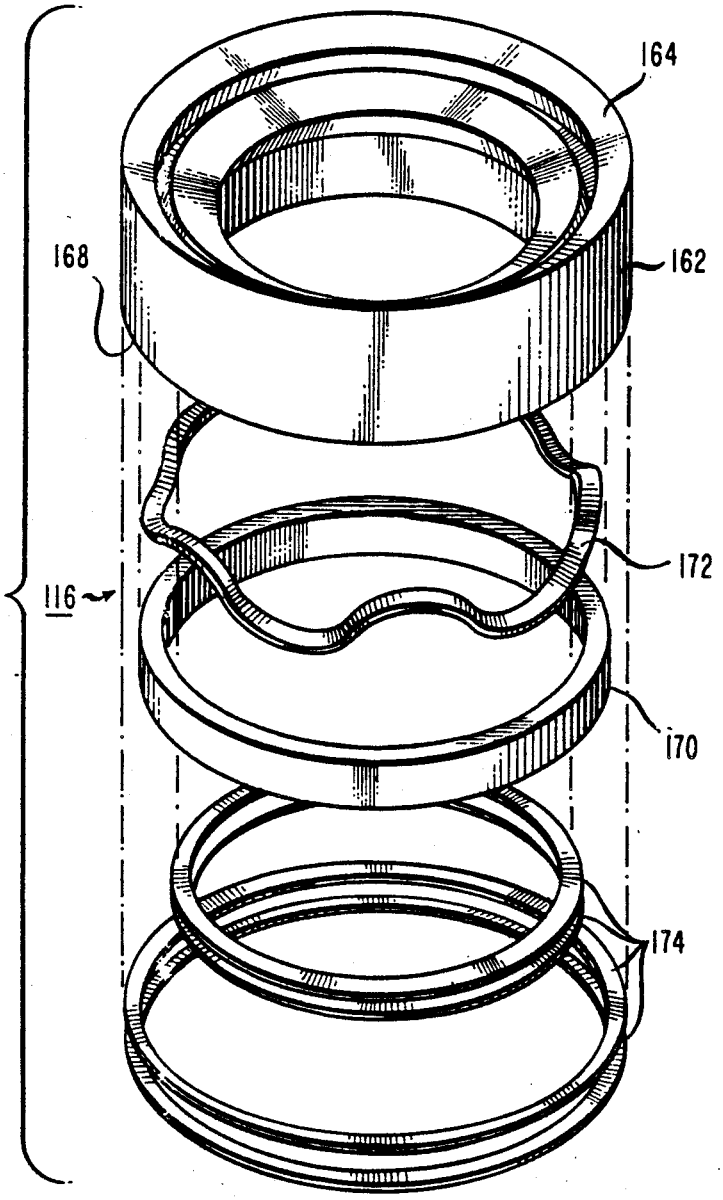
FIG. 15 is an exploded perspective view of a third embodiment of a sealing ring.
Figure 16:
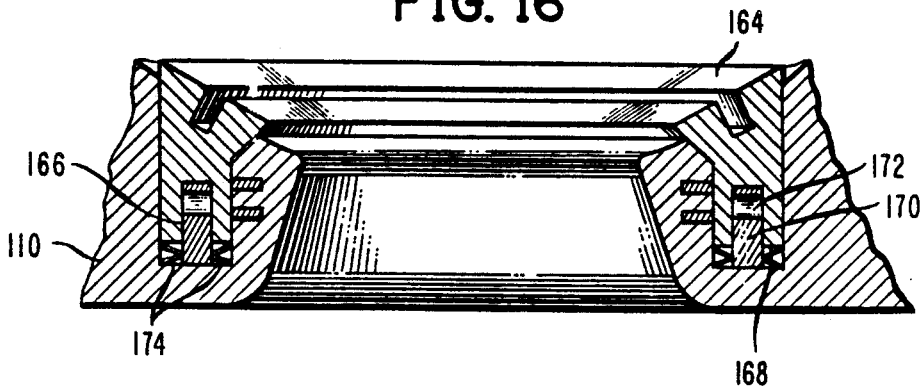
FIG. 16 is a sectional view of the third embodiment of the sealing ring.

Considering FIG. 15, there is shown an exploded perspective view of a third embodiment of a sealing ring and FIG. 16 which is a cross sectional view of the third embodiment of the sealing ring. The third embodiment of the sealing means 116 is again positioned within an annular indent 160 about the inlet port or the outlet port of lower half 110 of the split head assembly. The third embodiment of the sealing ring, 162, has an upper surface 164 which is arcuate in order to conform to the surface of the drum accommodating cavity and contact the intake spherical drum 10 or exhaust spherical drum 30. Sealing ring 162 has an annular indent 166 in lower end 168 in order to accommodate a pressure ring 170. Pressure ring 170 fits into indent 166 and has a wave spring or bevel spring 172 positioned in its indent or groove. Positioned about lower portion 168 of sealing ring 162 are another pair of either beveled or waved springs 174 in order to maintain an upward pressure on sealing ring 162 so that upper surface 164 maintains contact with intake spherical drum 10 or exhaust spherical drum 30. Upper surface 164 may have one or more grooves in its surface to aid in the sealing contact with intake drum 10 or exhause drum 30.

Applicant's embodiment as disclosed herein shows spherical intake and exhaust drums mounted on a splined shaft 22. Splined shaft 22 would have a space to slidable bearing surface positioned thereon in order to contact bearing surfaces 130 with respect to the split head assembly. It will be recognized by those skilled in the art, that the spherical intake and exhaust drums 10 and 30 could be mounted on shaft 22 by means of another method. Additionally, the embodiment shown discloses intake and exhaust spherical drums 10 and 30 mounted on a single shaft 22. A multi-shaft mounting method could be incorporated whereby the intake spherical drums 10 are mounted on a first shaft and the exhaust spherical drums 30 are mounted on a second shaft within a split head assembly and within drum accommodating cavities within the split head. The operation of the spherical valve assembly would be identical to that disclosed herein with the exception that the exhaust drums would rotate on a separate shaft from the intake drums which would permit redesign or alignment of the inlet port providing the fuel-air mixture to intake spherical drum 10 and the exhaust conduit evacuating the exhaust gases from exhaust spherical drum 30.

Still further, the embodiment disclosed herein is with respect to a four-cycle engine. By increasing the number of intake apertures 24 on intake spherical drum 10 and increasing the number of exhaust passageways 40 in exhaust spherical drum 30, and reducing the rotation of shaft 22 and spherical drums relative to the crankshaft and piston reciprocation, Applicant's invention would provide the advantages of multi-valve engines which have multiple intake and exhaust valves per cylinder. This permits shaft 22 to rotate at an arithmetically progressive lower revolutions per minute than the crankshaft providing less wear and tear on the engine. All of the aforementioned embodiments can be accomplished without departing from the scope and sphere of the Applicant's invention as disclosed herein.

While the above matter describes and illustrates the preferred embodiment of the invention, it should be understood that the invention is not restricted solely to the described embodiments, but that it covers all modifications which would be apparent to one skilled in the art and which would fall within the scope and spirit of the invention.

I claim:

1. An improved rotary intake valve for use in a rotary valved internal combustion engine, which comprises:

a drum body of spherical section formed by two parallel planar side walls of a sphere disposed about a center thereof thereby defining a spherically-shaped end wall and formed with a shaft receiving aperture, said drum body formed with a circularly-shaped cavity in a side wall thereof and with a channel extending between said circularly-shaped cavity and an aperture formed in said spherically-shaped end wall.

2. The improved rotary intake valve as defined in claim 1 wherein said circularly-shaped cavity is U-shaped in cross section.

3. The improved rotary intake valve as defined in claim 1 wherein said aperture is circular in cross section.

4. The improved rotary intake valve as defined in claim 1 wherein said shaft receiving aperture is longitudinally formed on said center extending between said planar side walls.

5. The improved rotary intake valve as defined in claim 1 wherein an intersecting edge about said aperture is rounded with respect to said spherically-shaped end wall.

6. The improved rotary intake valve as defined in claim 1 wherein said planar side walls are symmetrically disposed about said center of said drum body.

7. The improved rotary intake valve as defined in claim 1 wherein said aperture is centrally disposed on said spherically-shaped end wall.

8. An improved rotary exhaust valve for use in a rotary valved internal combustion engine, which comprises:

a drum body of spherical section formed by two parallel planar side walls of a sphere disposed about a center of said sphere thereby defining a spherically-shaped end wall; and formed with a shaft receiving aperture, said drum body formed with a conduit extending between an aperture in said spherically-shaped end wall to an aperture in one of said planar side walls.

9. The improved rotary exhaust valve as defined in claim 8 wherein said aperture in said end wall is circular in cross section.

10. The improved rotary exhaust valve as defined in claim 8 wherein said shaft receiving aperture is longitudinally formed on said center extending between said planar side walls.

11. The improved rotary exhaust valve as defined in claim 8 wherein an intersecting edge about said aperture is rounded with respect to said spherically-shaped end wall.

12. The improved rotary exhaust valve as defined in claim 8 wherein said planar side walls are symmetrically disposed about said center of said drum body.

13. The improved rotary exhaust valve as defined in claim 8 wherein said aperture is centrally disposed on said spherically-shaped end wall.

* * * * *